US008723440B2

(12) United States Patent
Csikszentimrei

(10) Patent No.: US 8,723,440 B2
(45) Date of Patent: May 13, 2014

(54) AC VOLTAGE REDUCTION BY MEANS OF A TRANSFORMER

(75) Inventor: Kálmán Csikszentimrei, Szeged (HU)

(73) Assignee: Gradix Holdings Ltd. (SC)

( * ) Notice: Subject to any disclaimer, the term of this patent is extended or adjusted under 35 U.S.C. 154(b) by 99 days.

(21) Appl. No.: 13/575,484

(22) PCT Filed: Sep. 9, 2010

(86) PCT No.: PCT/HU2010/000096
§ 371 (c)(1),
(2), (4) Date: Jul. 26, 2012

(87) PCT Pub. No.: WO2011/092527
PCT Pub. Date: Aug. 4, 2011

(65) Prior Publication Data

US 2012/0306402 A1 Dec. 6, 2012

(30) Foreign Application Priority Data

Jan. 26, 2010 (HU) ..... 1000054

(51) Int. Cl.
*H05B 41/26* (2006.01)

(52) U.S. Cl.
USPC ..... 315/282; 315/248

(58) Field of Classification Search
None
See application file for complete search history.

(56) References Cited

U.S. PATENT DOCUMENTS 4,256,993 A * 3/1981 Morton ..... 315/106
4,415,839 A * 11/1983 Lesea ..... 315/308
4,443,739 A * 4/1984 Woldring ..... 315/244
4,929,871 A * 5/1990 Gerfast ..... 315/205
4,958,107 A * 9/1990 Mattas et al. ..... 315/289
4,959,593 A * 9/1990 Joanino ..... 315/290
5,103,140 A * 4/1992 Cocoma et al. ..... 315/248
5,118,996 A * 6/1992 El-Hamamsy et al. ..... 315/248

(Continued)

FOREIGN PATENT DOCUMENTS

CN 1122967 A 5/1996
DE 29817222 U1 1/1999

(Continued)

OTHER PUBLICATIONS

International Search Report for PCT/HU2010/000096 dated Jul. 5, 2011.

(Continued)

*Primary Examiner* — Crystal L Hammond

(57) ABSTRACT

The invention relates to an AC voltage conversion and switching device comprising a main circuit and a switching circuit. The input of the device is connected to the power supply, and the output to the consumer. In the main circuit a controlled transformer (T) is inserted. The essence of the invention lies in that the secondary coil (6) of the transformer (T) is connected in series between the input (8) and the output (10) for decreasing the voltage at the consumer (F) during operation, and the secondary coil (6) of the transformer (T) is bridged by a first controlled switch (12), whereas the primary coil (7) of the transformer (T) is connected in series with a second controlled switch (18), and the serial circuit formed by the primary coil (7) and the second controlled switch (18) is connected parallel with the consumer (F), the switches (12; 18) are in an operational connection with a central control unit (K).

8 Claims, 5 Drawing Sheets

(56) References Cited

U.S. PATENT DOCUMENTS

| | | | | |
|---|---|---|---|---|
| 5,140,227 | A * | 8/1992 | Dakin et al. | 315/248 |
| 5,545,971 | A | 8/1996 | Gomez et al. | |
| 5,925,984 | A * | 7/1999 | Fischer et al. | 315/219 |
| 6,326,773 | B1 | 12/2001 | Okuma et al. | |
| 6,456,015 | B1 * | 9/2002 | Lovell et al. | 315/248 |
| 7,218,356 | B2 * | 5/2007 | Rowe | 348/521 |
| 2002/0074953 | A1 * | 6/2002 | Lovell et al. | 315/248 |
| 2006/0055248 | A1 | 3/2006 | Archdekin et al. | |
| 2007/0205729 | A1 | 9/2007 | Garbowicz et al. | |
| 2007/0247078 | A1 * | 10/2007 | Kwon | 315/200 R |

FOREIGN PATENT DOCUMENTS

| | | | |
|---|---|---|---|
| EP | 637122 | A1 | 2/1995 |
| EP | 0807311 | B1 | 11/1997 |
| EP | 2107861 | A1 | 10/2009 |
| HU | 181221 | | 6/1983 |
| SU | 936290 | A1 | 6/1982 |
| WO | 2006028781 | A1 | 3/2006 |

OTHER PUBLICATIONS

Hungarian Search Report dated Nov. 12, 2009.
Hungarian Search Report dated Jul. 17, 2012.

* cited by examiner

AC VOLTAGE REDUCTION BY MEANS OF A TRANSFORMER

The invention relates to an A.C. voltage conversion and switching device preferably connected to lighting circuits for reducing the consumption of discharge lamps so that it should provide energy for the ignition period at switching on the lamps without any voltage decrease.

BACKGROUND OF THE INVENTION

For operating lighting devices, the manufacturer determines a voltage so called rated voltage and keeping and maintaining this voltage the parameters given by the manufacturer for said lighting source are warranted. From the light emitted by the light source in the visible spectrum of light, and measured by a photometer being made according to CIE standards, can be determined the radiated power, further on the output light power.

EP 0807311 describes a device for uninterrupted voltage control with an autotransformer where at least one switching element 11 is connected in the primary circuit 2 of the transformer for switching out and at least one further switching element 9 is connected in the primary circuit 2 of the transformer or connected parallel with the secondary circuit coupled to the consumer. In case the voltage on the consumer should be switched over switching elements 9, 11 are controlled so that the secondary coil 13 operates as choke. The aim of the invention is to realize the operation with an uninterrupted switch over. No teaching can be found regarding the increase of the illumination effect and regarding the special measure of the transformer.

WO2006/028781 describes a device for control the operation of discharge lamps. The circuit arrangement is similar to the device described in EP 0807311. The aim of this invention is written in lines 17-22 and lines 25-27 on page 5. Accordingly the transition from full voltage to a reduced voltage occurs without an interruption of the current flow to the lighting unit. There is also a thermal analog device 36 to insure that the lighting unit can remain lighted when the voltage level is reduced for sustained operation. EP2 107 861 and DE 298 1722 both describe supply units for changing voltage on a consumer without interruption of the supply voltage.

According to prior art it is known that in the case of fluorescent lighting devices a 15-20% reduction in the power supply related to the rated voltage results in a smaller decrease in the output lighting power than in the electric power. In case of reduction in the electric power by 25-35%, typically by 25%, the output lighting power decreases by 10-25%, typically by 20%.

It is also known that a reduction of the power supply by 15-20% results in increase of the life time of fluorescent lighting devices by 1.5-2.5 times.

There are devices available in the commercial market solving the problem of decreasing lighting energy by reducing the supply voltage. In these devices transformers are applied the iron core and the copper coils of which together represent a significant mass and the transformer is bulky. In transformers, the idle voltage i.e. the voltage without any load might be different from the voltage when the transformer is connected to a load. The difference can be even 40-50%. The energy for supplying the consumer passes the transformer through an inductive coupling.

There are solutions known from the prior art using an AC electromechanical voltage control device. The principle of this solution is that the change of the input voltage is controlled automatically by a transformer coupled in series with the load and supplied through another transformer having variable ratio so that the output voltage should always be at the appropriate level. The main draw-back of this solution is that it contains mobile elements for varying the ratio of the transformer. Such a solution is published in the patent specification. CN 1 122967. In this solution, the secondary coil of a transformer is coupled in series to the consumer, whereas by an appropriate tapping and controlling of the primary coil, the voltage of the secondary coil can be changed within a wide range.

The price of a transformer for a given power is reimbursed at general use in about two years, thus the expected profit remains low.

A further method known from the prior art is when in bureau-houses or in separate lighting units, a part of the whole system is lightened only, a central step-down transformer provides a higher voltage to the whole system in order to help starting the part of the system to be switched-on. Sensing that the circuit for lighting a part of the whole system being switched-on cab be solved by replacing each switch of the lighting system for quadripole switches. Two poles of each switch serve the switching on of the lighting circuit, two transmit the information on switching-on to the central unit through a wiring built out for this purpose. The construction of the system requires a lot of supplementary work. In addition to replacing the switches, two wires should be arranged to the central unit from each switch. This work is complicated and needs wall drilling and wiring. Working costs of building and placing the supplementary elements are high without considerable saving the return time of the project is definitely more than two years.

There are also several control devices having AC voltage control transformers known form the prior art. The secondary coil of the transformer is coupled in series between the power supply and the load, the primary coil of the transformer is connected to the supply voltage. The device comprises also switches for either exciting the primary coil from the input voltage, or short-circuiting the primary coil by semiconductor switches. The device can provide lower and higher voltages as well, corresponding to the state of the semiconductor switches. After switching, the switches are high loaded due to the inductivity of the inductive elements, i.e. the primary and secondary coils. In the moment of switching, instantaneous pulses of 1000 V or higher may occur. This represents a remarkable load on the semiconductors leading to a quick damage. The deviation from the standard rated voltage of 350 V is very large, besides its occurrence is seldom and random.

SUMMARY OF THE INVENTION

The aim of the present invention is to provide a voltage conversion and switching device by eliminating the drawback of the devices known from the prior art by reducing the input voltage to the ⅕-⅐ of the total input voltage in such a way that when switching on, the device provides the total input voltage until the ignition of the light sources (e.g. for 10-100 s), and only after said time period should the device switch to the reduced voltage in that way that during switch over from the total input voltage to the reduced voltage the circuit should not be interrupted.

A further aim of the invention was to realise the above mentioned change over by an AC voltage converter having a better efficiency and smaller mass than that of used earlier. Voltage conversion is performed by a switch ensuring operation without interrupting the continuous galvanic connection in the main circuit, and the device can be prepared easily from elements available commercially and manufactured in large numbers.

A further aim of the invention was that the change of the output voltage in loaded state should not be higher than 3%, and the cost of the device should not be higher than the cost of the other devices made for the same purposes. An important characteristic feature is to decrease the weight and increase the efficiency in relation of the other devices made for the task.

The aim of the invention has been solved by providing two circuit arrangements being in an inductive connection. In the main circuit the main coil (secondary coil) is coupled in series with the lighting bodies, whereas the second coil (primary coil) is the switching coil, and the two coils are in an inductive coupling by the iron core. The main coil is coupled in series, the switching coil parallel to the lighting bodies. The excitation of the main coil determines the change in the output voltage.

The invention relates thus to an AC voltage conversion and switching device, comprising a main circuit and a switching circuit, and a first and a second input, as well as a first output and a second output connected to the consumer, and a transformer operated by controlled switches in the main circuit is arranged.

The essence of the invention is that the secondary coil forming the main coil of the transformer is coupled in series between the input and the output in a way that decreases the voltage on the consumer during its operation, which is bridged by a first controlled switch as main switch, whereas the primary coil of the transformer forming the switching coil is connected in series to a second controlled switch, and the serial circuit formed by the primary coil and the second controlled switch is connected parallel coupling to the consumer, and the switches are operated by a central control unit.

According to an embodiment of the invention the serial circuit formed by the primary coil and the second controlled switch is preferably connected between the two inputs.

According to a further embodiment of the invention the serial circuit formed by the primary coil and the second controlled switch is preferably connected between the two outputs.

According to an embodiment of the invention it is also preferable if the primary coil is provided with at least one tap, which is (are) connected to the common point of the input and the output via serially connected voltage adjusting switch(es).

The first switch coupled parallel to the secondary coil is preferably controlled by the central control unit in a switch-over mode near to the zero value of the mains voltage.

Between the input and the secondary coil preferably a circuit is connected consisting of an energy meter for the main circuit, and another parallel circuit comprising in its one branch a resistance, in the other one a further energy meter and a serial resistance are connected after each other.

In the case of phase-compensated consumer, for adjusting the resultant cos (ϕ), an inductive coil is connected in series with the secondary coil, and the serial circuit thus formed is connected parallel with the first switch.

Another possibility for phase-compensated consumers for adjusting the resultant cos (ϕ) is if the switch coupled in series with the primary coil is connected to one of the tap of the secondary coil.

The transformer is preferably a toroidal transformer. The turns of the secondary coil have an increased thickness, preferably by 20%, and it is also preferred if the primary and secondary coils have identical directions of winding.

BRIEF DESCRIPTION OF THE DRAWINGS

The above and other objects, effects, features and advantages of the invention will become more apparent from the following description of the embodiments thereof

Figure 1:
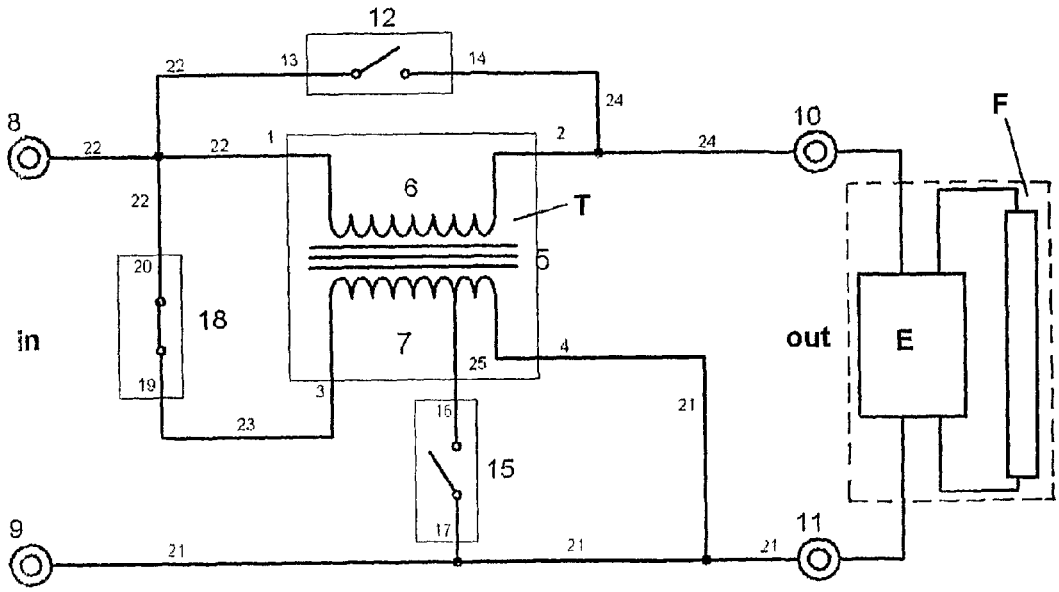
FIG. 1 is the block-scheme of the device according to an embodiment of the invention.

In the embodiment of the voltage control and switching device of present invention shown in FIG. 1, the supply voltage, e.g. the mains voltage is connected to the first input 8 and the second input 9 of the device, whereas to its first output 10 and second output 11 of the device is a consumer F, e.g. a fluorescent lamp or other discharge lamp, connected. The Transformer T has two windings a primary winding t and a secondary winding 6. The secondary coil 6 of a transformer T is coupled in series to consumer F so that output 1 of the coil 6 of the transformer T is connected to input 8 of the device, while output 2 of the coil 6 of the transformer T is connected to output 10. Parallel to secondary coil 6, between the first output 8 and the second output 10, a switch 12 is inserted which serves as the main switch. The first output 13 of switch 12 is connected to input 8, thus it is connected to the output 1 of secondary coil 6 via wiring 22 as well. The second output 14 of switch 12 is connected to the output 2 of secondary coil 6 and to the output 10. Output 3 of the primary coil 7 of the transformer T forming the switching coil is connected to the first output 19 of a switch 18 via a wiring 23. The second output 20 of switch 18 is connected to first input 8 via wiring 22. Input 9 and output 11 of the device are connected via wiring 21. To this wiring 21, the other output 4 of primary coil 7 is also connected. The primary coil 7 functioning as switching coil is connected parallel to consumer F through a bipolar switch 18. On primary coil 7, at least one tapping 25 is formed, which is (are) coupled to wiring 21 via switch(es) 15 so that its one output 16 is connected to the tap 25, the other output 17 to wiring 21. The output voltage of transformer T may be changed so that the number of turns in primary coil 7 is changed by short-circuiting some of the turns, i.e. by switching-on of switch(es) 15. By making a short circuit between certain numbers of turns or taps of the primary coil 7 (or switching off some of the turns) results in different voltage levels at the output.

Operation of the device shown in FIG. 1 is as follows:

The higher voltage needed for starting consumer F made of lighting bodies can be achieved, according to FIG. 1, by switches 12 and 18, and by applying the lowest load on switches 12 and 18. The increased voltage is identical with the mains voltage on inputs 8 and 9 of the device, thus it is the most efficient at starting. The change of voltage is ensured by switches 12 and 18. According to FIG. 1, switching off switch 12 prevents connecting of the input voltage directly to outputs 10 and 11, the other switch 18 ensures the energizing of primary coil 7, and thus it prevents the appearance of a reduced voltage at the output. In other words, switch 12 is element which short-circuits the secondary coil 6, whereas switch 18 energizes the primary coil 7. With this arrangement it can be achieved that the switches are under lowest load, thus using semiconductors as switching elements, the parameters limits of the semiconductor switches do not need to be oversized.

Figure 4:
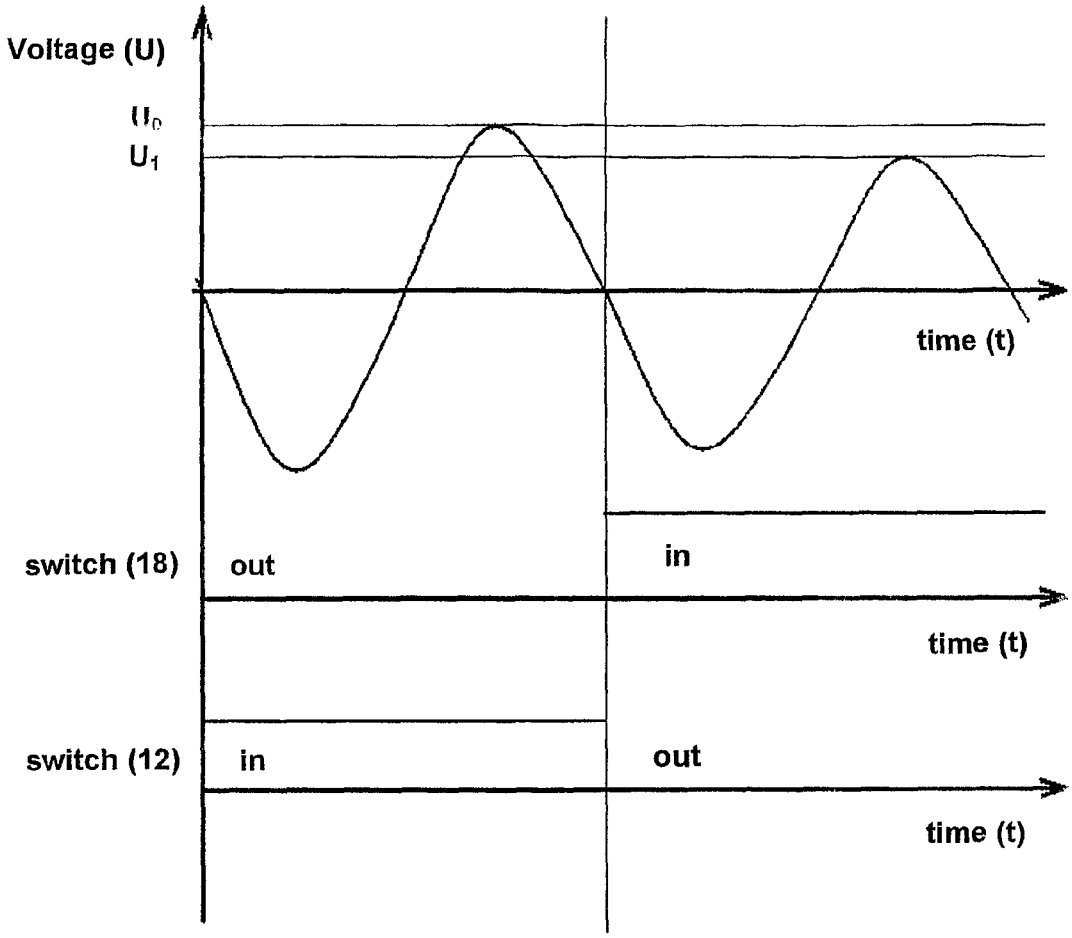
FIG. 4 shows the switching-on time diagram.

FIG. 4. show the output voltage U of the device as function of the time t. This output voltage U is connected to the adapter E of the fluorescent lamp representing consumer F. In the moment of switch-on, which is in t=0 transition of the mains voltage Uo, switch 18 switches on, switch 12 switches off. At this time the mains voltage $U_0$ decreases at outputs 10 and 11 to $U_1$. Voltage decrease ($U_0$-$U_1$), i.e. the loss of voltage on the consumer F, is completed by the voltage on the secondary coil 6 of transformer T. Thus it can be achieved that switching occurs properly and the load on the switching elements is the least. With other words the value one of sine wave of the supply voltage at the output is $U_0$, but after the time t of next zero transition increases to the necessary reduced voltage $U_1$. Thus coils 6 and 7 are switched with a minimal voltage pulse.

The output voltage $U_{sz}$ of the secondary coil 6 of transformer T reduces the voltage on consumer F. This voltage can be changed by changing the number of turns of the primary coil 7. Increasing the number of turns of the primary coil 7 the excitation of primary coil 7 decreases, decreasing thereby the output voltage $U_{sz}$, whereas decreasing the number of turns increases the excitation, thus the output voltage $U_{sz}$ increases. The change in the output voltage $U_{sz}$ is proportional to the number of turns short-circuited in the primary coil 7. The output voltage $U_{sz}$ changes proportional to the change in the number of turns in primary coil 7. This change in the output voltage $U_{sz}$ can be realized also during operation by short-circuiting the excess turns. For this purpose a bipolar switch 15 is inserted in series between branching 25 of primary coil 7 and wiring 21. The primary coil 7 can be tapped at different number of turns, thus a different number of turns can be short-circuited (or excluded) making thereby possible to change the output voltage $U_{sz}$ even during operation. The more switches 15 are short-circuited, the higher will be the output voltage, and vice versa. Increasing the number of taps and switches, the size of voltage steps can be refined. Correspondingly, using two switches 15 for short-circuiting the change of the output voltage can be realized in four levels and using three switches 15 the change in the output voltage can be divided into nine voltage levels.

Comparing the device according to the invention with other solutions using traditional transformer for the reduction of the energy demand of discharge plasma lighting devices saving higher than 10% preferably 30-45% can be achieved with the transformer T connected in series with the consumer according to the invention i.e. the primary coil 7 is connected parallel, the secondary coil 6 in series to consumer F whereas decrease in light intensity; 5-15%, typically 10% only. (see FIG. 1).

Figure 6:
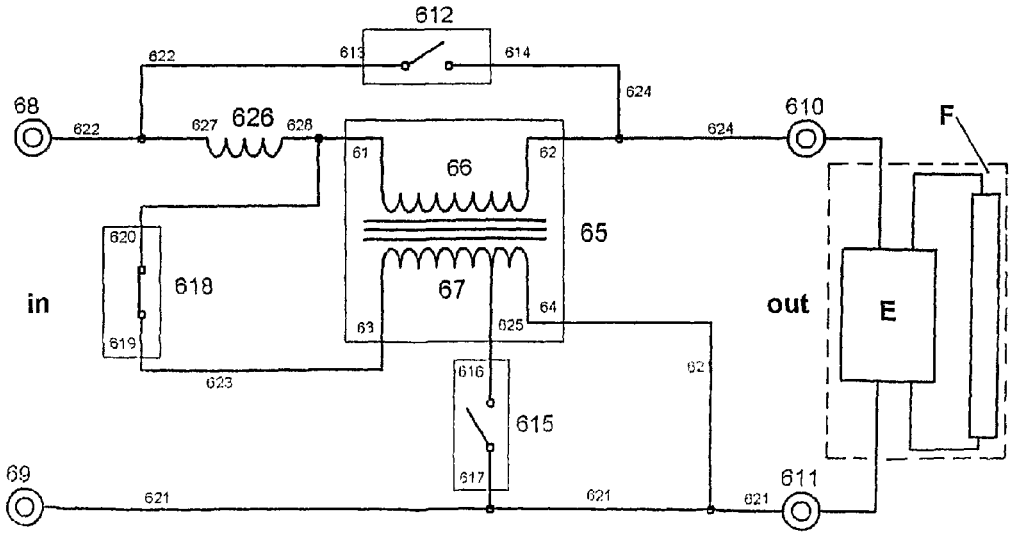
FIG. 6 is one of the possible embodiments which can be used for adjusting the resultant cos (ϕ) for phase-compensated consumers.
Figure 7:
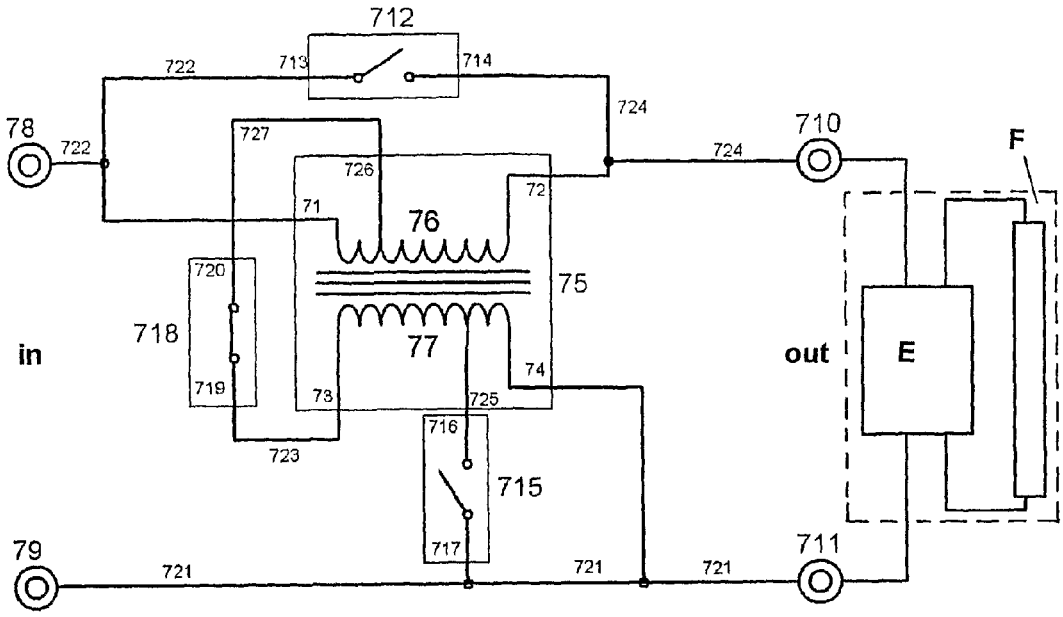
FIG. 7 shows another embodiment for adjusting the resultant cos (ϕ) in the case of phase-compensated consumers.

Primary coil 67 coupled parallel to consumer F produces a phase shift, and increases the value of cos ϕ. In case if consumer F is phase-compensated, it may occur that the shift modifies the value of ϕ to greater than 90°, decreasing thereby the value of cos ϕ under 0.6. For compensating this, two possible solutions exist. According to the first solution, shown in FIG. 6, an inductive coil 626 is coupled in series with secondary coil 66 compensating the phase shift. In another solution, the output 73 of primary coil 7 is coupled to a tapping 726 of secondary coil 76. This is shown in FIG. 7.

By applying this solution, the transformer T in FIG. 1 coupled in series performs the task by a power being 5-7-times lower at the same current intensity than the traditionally coupled device. This means also a reduction in its size and mass.

Heating up of transformer T connected in series with the load according to embodiment shown in FIG. 1 can be reduced, and some other features can be improved, thus saving can be increased, preferably by 2-3%, and the light intensity can be decreased preferably by 1-2%, if the transformer applied is a toroidal transformer.

The turns in secondary coil 6 of the transformer T in FIG. 1, coupled in series with the consumer F, are made preferably of wires by 20% thicker than in the traditional solutions, thus less heating up occurs.

In case of a toroidal transformer and thicker turns in secondary coil 6, the power needed can be decreased preferably by 20%, while keeping the improved results in saving, light intensity loss, heating up. By applying this solution, the power needed can be reduced as compared to the traditionally coupled transformer to its ⅐-⅕ part. At the same time, the size and mass of the device is also smaller.

In what follows, an example will be given for the application of a toroidal transformer.

The toroidal transformer has a power of 250 W, secondary coil has a voltage of 31V, primary coil 6 has a voltage of 230 V. The thickness of the copper wire in secondary coil 6 is by 20% larger. According to the invention, the secondary coil 6 is connected in series with consumer F, while the primary coil 7 is connected parallel to the consumer F. The reduced output voltage is 199 V, if the input is 230 V. The instrument has an autocirculation cooling, it can even bear when loaded by a power of 2000 W, and bear a peak load of 2250 W for 1-2 hours, by using forced cooling it van operate continuously a system of 2250 W power, and depending on the type of the lighting body, from this energy is 30-40% saved.

An embodiment may be preferable, in which one single supply cable connected to a central unit K used for lighting is capable to transport the signal applied for increasing the lighting voltage; there is no need to connect the wires of part lighting units separately to central unit K.

Figure 5:
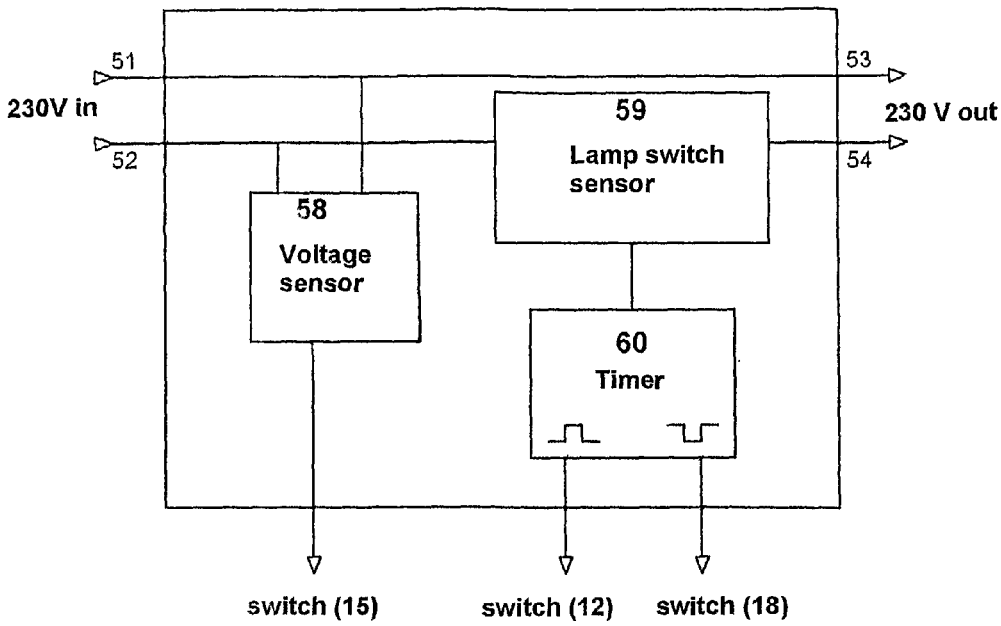
FIG. 5 is the block-scheme of one embodiment of the control unit.

An exemplary embodiment of this arrangement is shown in FIG. 5.

Inputs 51 and 52 of the central unit K are connected to the mains voltage of 230 V which gets without loss to outputs 53 and 54. In the meantime, consumer F observes the switch-on sign and the input voltage of the lamp. Central unit K comprises a voltage sensor unit 58 connected parallel with inputs 51 and 52, The output of the voltage sensor unit 58 is connected to the control input of a switch 15; a lamp switch sensor 59 is connected in series between input 52 and output 53; the output of the 59 lamp switch sensor is connected to a timing circuit 60 one output of which is connected to the control input of switches 12 and an other output to the control input of switch 18. When a pulse for switching-in has been received, the input voltage 230 V is switched to the outputs 53 and 54 without any loss. After 10-100 s (depending on the lighting body) energy saving voltage will be switched. It can be seen in the FIG. 5. that in order to determine the change in the input voltage, the two poles of the mains should be observed, whereas to sense the switching-on of the lamp it is enough to observe one wire only.

An embodiment is also possible in which a sign from the switched-on consumer is transmitted on the supply cable to central unit K via a supply line, where a suitable sensor is situated starting the high voltage necessary for ignition. This sign is generated by trigger circuit having a time delay some, preferably 2 sec. Two seconds are enough for the detection of the signal.

In given cases, the current needed to the operation of lighting bodies may start the voltage conversion. In central unit K, the change of current is detected, and this is what starts the voltage for ignition.

Figure 2:
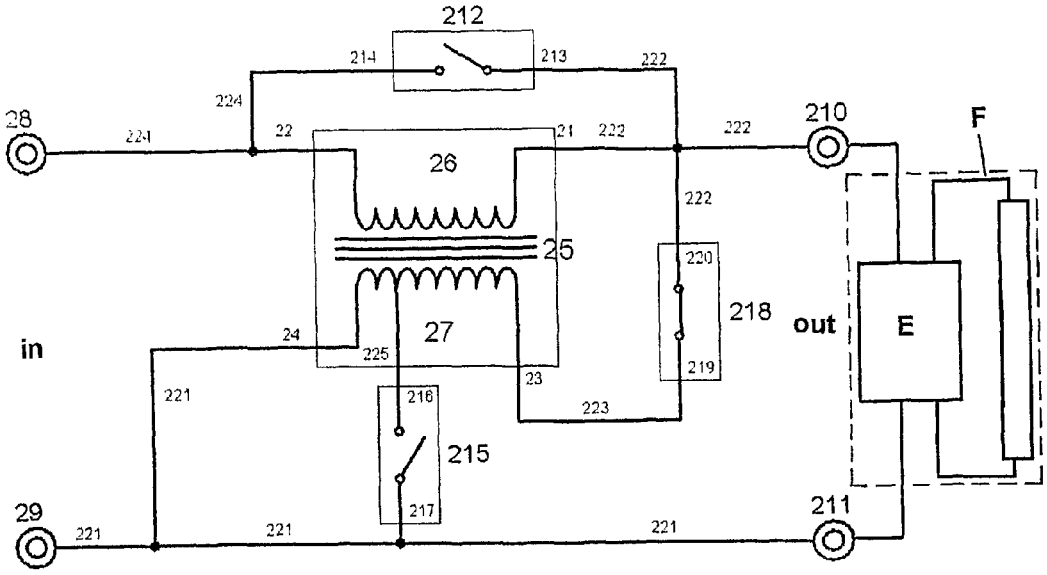
FIG. 2 shows the block-scheme of another embodiment of the invention.

FIG. 2 illustrates another preferable embodiment.

Consumer F, here a fluorescent lamp or other discharge tube is connected to the outputs 210 and 211 of the device. First output 22 of coil 26 of transformer T is connected to the first input 28, the second output 21 to output 210, thus transformer T is connected in series to consumer F. The first output 23 of primary coil 27 and the first output 219 of switch 218 are connected via wiring 223. The second output 220 of switch 218 is connected to the first output 210 via wiring 222. The first output 213 of switch 212 being the main switch is connected to first output 210, and the second output 21 of secondary coil 26 are connected via wiring 222. Input 29 and output 211 are connected via wiring 221. The other output 24 of primary coil 27 is connected to wiring 21. Primary coil 27 forming the switching coil is connected parallel to consumer F via bipolar switch 218. One sided output 216 of switch 215 is connected to the tap 225 of primary coil 26, the other sided outputs 217 are connected to wiring 21. On coil 26 of the transformer T the output voltage can change due to a change in the number of turns of primary coil 27 by short-circuiting the excess turns, by switching on switch(es) 215. Several taps of primary coil 27, its branching and their short-circuiting may result in several voltage levels at the output. The output voltage has two states, corresponding to the two positions of switch 215. According to FIG. 2, correspondingly to the positions of the switches, one of the outputs 24 of primary coil 27 is connected to input 29, its other output 23 is connected to the first output 219 of switch 218 via wiring 223, thus in operational mode the modulator device decreases the fluctuation at the output produced by the effect of the output voltage load, i.e. on consumer F, as load. In the position of switches shown in the FIG. 2, the device ensures a reduced voltage at the output, due to the position of switch 212 which is the main switch. When switch 212 is switched over into a different position, the position of switch 218 should also be changed, and then the input voltage appears at the output. In the switched-on position of switch 215 provides the higher voltage state of the reduced voltage. When switch 215 is switched off, at the output the lower one of the reduced voltage appears.

Figure 3:
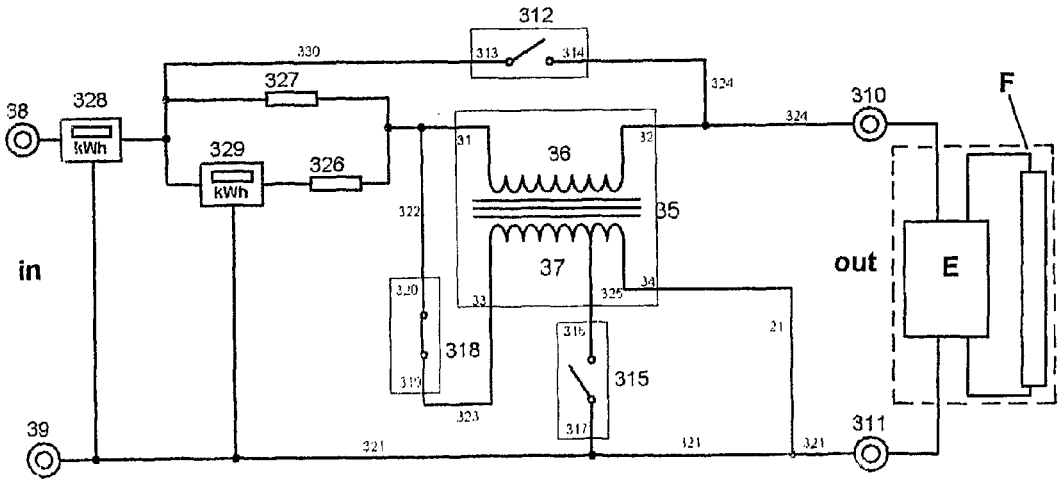
FIG. 3 illustrates the block-scheme of a third embodiment of the invention.

A further preferable embodiment can be developed so that the saving can be measured by means of current divider resistances as shown in FIG. 3.

This embodiment is similar to the one shown in FIG. 1, the difference consists in that between the output 31 and the input 38 of the secondary coil 36 of transformer T a series coupling of an energy meter 328 and a parallel circuit is arranged. One branch of the parallel circuit comprises a resistance 327, the other branch an energy meter 329 and a resistance 326 connected in series. One of the outputs of main switch 312 is connected to the common point of energy meter 328, resistance 327 and resistance 329, the other output 324 to output 310.

Known values are supply voltage $U_0$ and the output voltage $U_t$ of the transformer. The AC power without voltage reduction is: $P_0=U_0*I_0 \cos(\phi)$. In energy-saving, reduced voltage state: $P_1=U_1*I_1 \cos(\phi)$. $U_1=U_0-U_t$. The saving is: $P_m=P_0-P_1$. By introducing the internal resistance of the consumer R, then in a simpler form:

$$U_0^2 \cos(\phi_0)/(U_0-U_t)^2 \cos(\phi_1)*100$$

The above ratio provides the percentual saving of the reduced energy, in other words, energy meter 328 measures the reduced energy consumption, and from the percentage that value can be calculated by which the energy meter shows less. Two resistances 327 and 326 are connected parallel. Their ratio: $U_0^2 \cos(\phi_0):(U_0-U_t)^2 \cos(\phi_1)$. The internal resistance should also be taken consideration as a correction factor. In case of parallel connected resistances, current is divided according to the ratio of the resistances, while the voltage remains the same. If in a circuit of $(U_0-U_t)^2 \cos(\phi_1)$ an energy meter 329 is inserted, saving is measured. When the values measured by energy meter 328 and that measured by energy meter 329 are added, the consumption of the circuit without saving is obtained. The added resistances of parallel connected resistances 327 and 326 can only be such values that the sum should not influence the operation of the system, i.e. between several tenth or hundredth of an Ohm depending on the resistance of the load. In other words, it should be commeasurable to the internal resistance of a fuse.

The invention claimed is:

1. AC voltage conversion and switching device comprising a main circuit and a switching circuit, the device has a first input and a second input both connected to the power supply, a first output and second output connected to the consumer, in the main circuit a transformer (T) operated by controlled switches is inserted, the secondary coil (6,26,36) of the transformer (T) being the main circuit is connected in series between the input (8,28,38,6,78) and the output (10,210,310, 610,710) for decreasing the voltage at the consumer (F) during operation, and the secondary coil (6) of the transformer (T) is bridged by a first controlled switch (12,212,312,612, 712) being the main switch, whereas the primary coil (7,27, 37,67,77) of the transformer (T) forming the switching coil is connected in series with a second controlled switch (18,218, 318,618,718), and the serial circuit formed by the primary coil (7,27,37,67,77) and the second controlled switch (18, 218,318,618,718) is connected parallel with the consumer (F), the switches (12,212,312,612,712; 18,218,318,618,718) are in an operational connection with a central control unit (K) characterized in that the primary coil (7, 27,37) is provided with at least one tap (25,225,325) and the tap(s) is (are) connected to the common point of the input (9,29,39) and the output (11,21,32) via voltage adjusting switches (15,215, 315) connected in series further on the transformer used is a toroidal transformer, and the thickness of the turns in the secondary coil, are larger preferably by 20%.

2. AC voltage conversion and switching device according to claim 1 characterized in that the serial circuit formed by the primary coil (7,37) and the second controlled switch (18,318) is connected between the two inputs (8,9; 38,39) of the device.

3. AC voltage conversion and switching device according to claim 1 characterized in that the serial circuit formed by the primary coil (27) and the second controlled switch (218) is connected between the two outputs (210,211) of the device.

4. AC voltage conversion and switching device according to claim 1 characterized in that the first switch (12,212,312) connected parallel to the secondary coil (6,26,36) in the time being near to the zero transition of the mains voltage is controlled by the central controlling unit (K) in a switch-over mode.

5. AC voltage conversion and switching device according to claim 1 characterized in that between the input (38) and secondary coil (36) in series a main circuit energy meter (328) and a parallel circuit containing in its one branch a resistance (327), and in the other one more energy meter (329) and a serial resistance (326) are connected.

6. AC voltage conversion and switching device according to claim 1 characterized in that in case of a phase-compensated consumer (F) for adjusting the resultant cos(ϕ), an inductive coil (626) is connected in series to the secondary coil (66), and to this serial circuit is the first switch (612) connected in parallel.

7. AC voltage conversion and switching device according to claim 1 characterized in that in case of a phase-compensated consumer (F), a switch (718) is connected in series for adjusting the resultant cos(ϕ) to the primary coil (77) for tapping the secondary coil (76).

8. AC voltage conversion and switching device according to claim 1 characterized in that the windings of the secondary coil (6,26,36) and the primary coil (7,27,37) have the same winding direction.

* * * * *